US005178551A

United States Patent [19]

Bach

[11] Patent Number: 5,178,551

[45] Date of Patent: Jan. 12, 1993

[54] DEVICE FOR PREVENTING UNAUTHORIZED INDIVIDUAL FROM PLUGGING IN ELECTRICAL APPARATUS

[76] Inventor: John R. Bach, 306 E. James Dr., Port Washington, Wis. 53074

[21] Appl. No.: 864,595

[22] Filed: Apr. 7, 1992

[51] Int. Cl.[5] ..... H01R 13/44

[52] U.S. Cl. ..... 439/133; 439/135; 439/367; 439/892

[58] Field of Search ..... 439/133-136, 439/147, 367, 892

[56] References Cited

U.S. PATENT DOCUMENTS

| | | | |
|---|---|---|---|
| 2,955,272 | 10/1960 | Gallardo | 339/37 |
| 3,345,600 | 10/1967 | Scherer | 339/37 |
| 4,653,824 | 3/1987 | Jason et al. | 339/37 |
| 4,671,587 | 6/1987 | Lerner et al. | 439/135 |
| 4,679,873 | 7/1987 | Brackett, Jr. | 439/134 |
| 4,718,856 | 1/1988 | Pinkerton et al. | 439/147 |
| 4,865,557 | 9/1989 | Kershaw | 439/133 |
| 4,957,445 | 9/1990 | Burke, Jr. | 439/134 |
| 4,957,446 | 9/1990 | Belsky | 439/134 |
| 5,097,103 | 3/1992 | Workman et al. | 439/133 |

FOREIGN PATENT DOCUMENTS

| | | | |
|---|---|---|---|
| 1354173 | 1/1964 | France | 439/133 |

*Primary Examiner*—Paula A. Bradley
*Attorney, Agent, or Firm*—Michael, Best & Friedrich

[57] ABSTRACT

A device for impeding an individual from plugging a electrical apparatus into a receptacle. The apparatus has a cord extending through a slot in the wall or cap of a container to capture the plug inside. The cap is of the child proof type. A lock bar can also be used to capture the plug in the container. The bar passes through opposed aligned slots and is secured by a padlock.

12 Claims, 2 Drawing Sheets

DEVICE FOR PREVENTING UNAUTHORIZED INDIVIDUAL FROM PLUGGING IN ELECTRICAL APPARATUS

BACKGROUND OF THE INVENTION

The invention relates to safety apparatus. More particularly, the invention relates to apparatus for preventing a child or an unauthorized individual from plugging in an electrical apparatus.

SUMMARY OF THE INVENTION

The invention provides a device for impeding an unauthorized individual from plugging an electric cord into an electric receptacle. The cord has a girth less than the girth of the plug and passes through a slot in the cover or wall of a container to capture the plug inside the container with access impaired by provision of a "child proof" cap.

The device can be used to impede use by an unauthorized person of an electrical apparatus (TV, power tools, etc.) by impeding plugging the electrical apparatus into a wall socket.

DETAILED DESCRIPTION OF THE PREFERRED EMBODIMENT OF THE INVENTION

Figure 3:
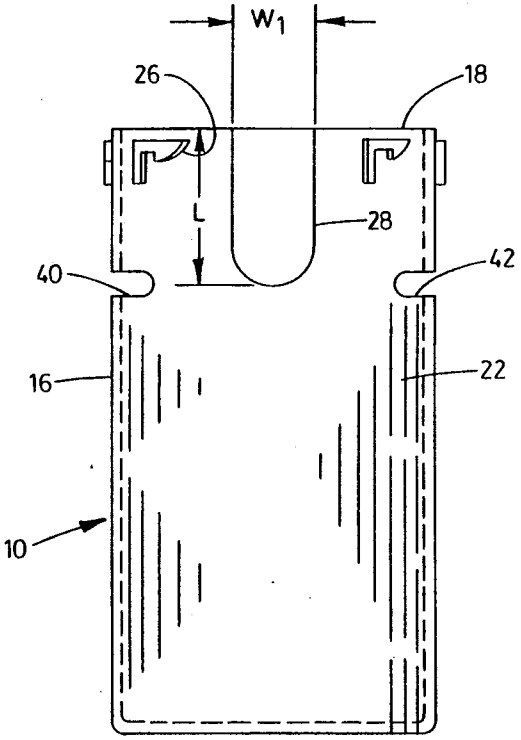
FIG. 3 is a front elevational view of the device of FIG. 1 with the cap thereof removed.
Figure 2:
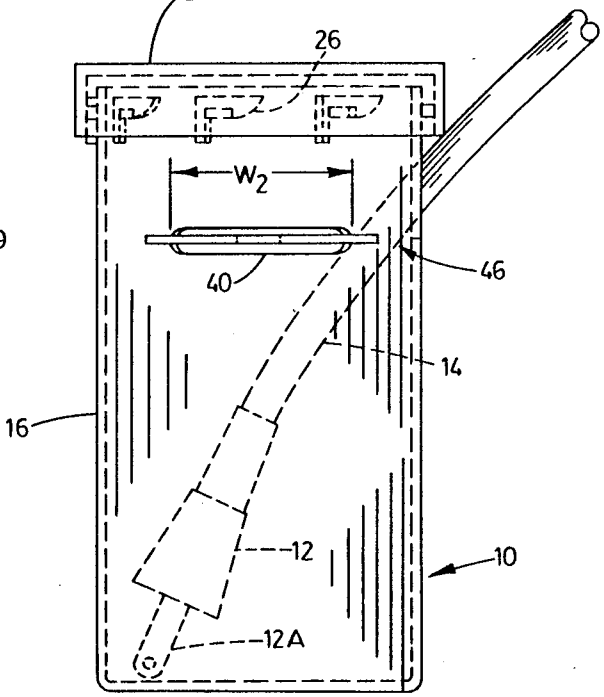
FIG. 2 is a side view of the device of FIG. 1.
Figure 1:
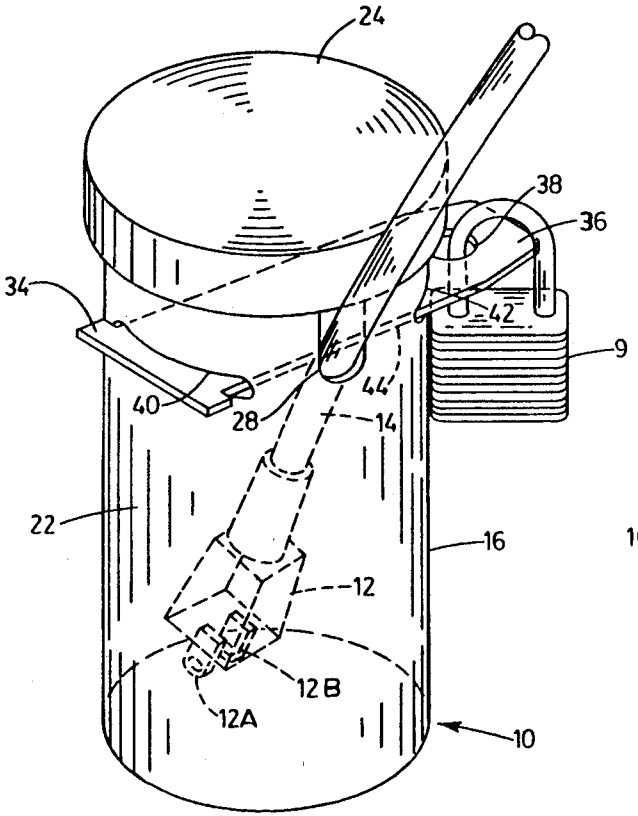
FIG. 1 is a perspective view of a device embodying various of the features of the invention, including a container, a cap, and a lock bar, and used with a plug of an apparatus and with a padlock.
Figure 6:
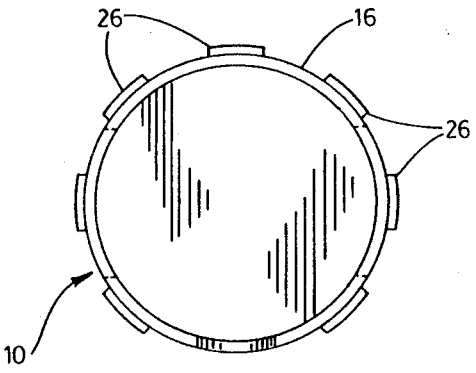
FIG. 6 is a top view of the container of the device of FIG. 1.
Figure 5:
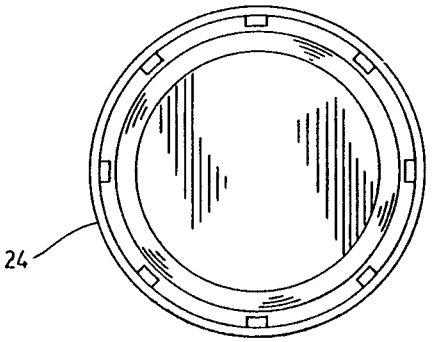
FIG. 5 is a bottom view of the cap of the device of FIG. 1.
Figure 4:
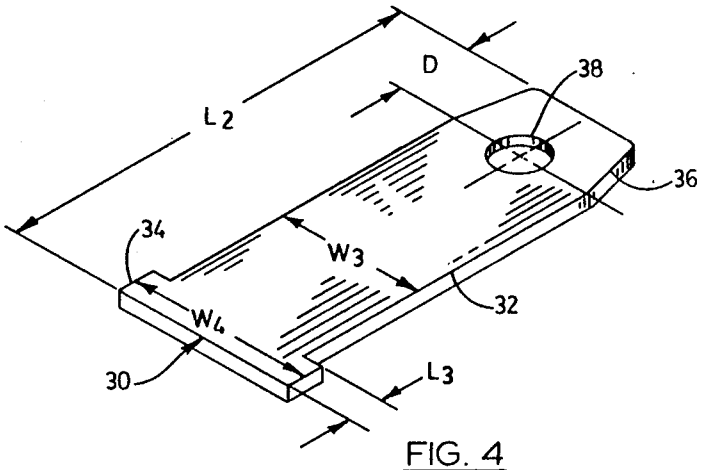
FIG. 4 is a perspective view of the lock bar included in the device of FIG. 1.

The device 10 impedes an unauthorized individual from inserting plug 12 of apparatus (not shown) into an electric receptacle. The apparatus has cord 14 having plug 12 which has a girth that is larger than the girth of the cord 14. The plug 12 is a standard electrical plug of the type having two male prongs 12A and 12B. The invention can be used with grounded plugs, European style plugs, or 220 volt plugs.

The device 10 comprises a container 16 having an open end 18. Although other shapes could be employed, the container 16 is an open ended cylinder. The container 16 can be manufactured of any of various types of materials but the illustrated embodiment consists of translucent plastic. The container has a diameter and height sufficiently large to receive the plug 12.

The device 10 includes means for selectively closing and opening the open end 18 of the container while the plug 12 is captured in the container 16 with the cord 14 extending out through slot 28 in the wall of the container 16. This means comprises a child proof cap 24 of any desired type (press-and-turn, squeeze-and-turn, etc.), and further comprises means 26 on the container 16, complementary to the child proof cap 24, for engaging the child proof cap 24 for enabling selective attachment and removal of the cap.

The cord 14 extends through the open-ended slot 28 in the side wall of the container when the open end 18 is closed by the cap 24. The slot 28 is sufficiently narrow so as to prevent the plug 12 of the apparatus from being removed from the container 16 through the slot 28 when the cap 24 is in place. Preferably, the slot 28 has a width of less than one half of an inch, which accepts most cords while not passing the usual plugs. The open ended slot could be in the cap but this is not thought to be as easy to manufacture.

The device 10 further comprises second capturing means, operable independently of (i.e. in addition to or instead of) the child proof cap 24, for selectively preventing removal of the plug 12 of the apparatus from the container 16, the second means being engageable by a padlock 9 to secure the second means to the container 16.

In the illustrated embodiment, the second capturing means comprises a generally planar metal lock bar 30 including a middle portion 32 having a first width $W_3$, including a first (large) end portion 34 having a width $W_4$ wider than the width of the middle portion 32, and including a second end portion 36 having therethrough a hole 38 for receiving the padlock 9.

The second means further comprises opposed, aligned slots or apertures 40, 42 through the wall of the container to receive the middle portion 32 of the lock bar while preventing passage of the large end portion 34 of the lock bar 30.

When the second means (including the lock bar 30) is in use, the first and second apertures 40 and 42 receive the middle portion 32 of the lock bar 30 and the first and second end portions 34 and 36 of the lock bar 30 are outside of the container 16. Space 46 between the segment 44 of the middle portion 32 and the wall of the container 16 allows the cord to pass therethrough but does not allow the plug 12 to pass therethrough so as to retain the plug 12 in the container 16. The second end portion 36 of the bar is outside the container, and padlock 9 can lock the bar in place.

Thus, in use, the child proof cap 24 can be used to retain the plug 12 in the container 16 and to thereby impede the child from plugging the plug 12 into a power socket. When the child attains a sufficient dexterity to be able to remove the child proof cap 24 from the container 16, the lock bar 30 can be used with a padlock, as described above, to retain the plug 12 in the container 16.

While a preferred embodiment of the invention has been described, various modifications are possible. Thus, the scope of the invention is to be limited only by the scope and spirit of the following claims.

I claim:

1. A device for impeding an unauthorized individual from plugging an electric plug into an electric receptacle, the plug having a cord extending therefrom, said apparatus comprising:

a container having an open end, a closed end opposite said open end, and a wall between said open end and said closed end, said wall having an outer surface and an inner surface, said container being capable of receiving said plug;

a child proof cap;

an open-ended slot in one of said container and said cap, said slot being sufficiently large to receive the cord for passage of the cord out of said container, and said slot being sufficiently small so as to prevent the plug from leaving said container through said slot;

means on said container, complementary to said child proof cap, for engaging the child proof cap for selective attachment and removal of said child proof cap to and from said container, said open end of said container being closed by said cap when said means engages said cap; and capturing means, operable independently of said child proof cap, for selectively preventing removal of the plug from said container, said capturing means comprising first and second opposed apertures in said wall of said container, and a lock bar including a middle portion receivable in said opposed apertures, including a first end portion outside of said container, proximate said first aperture, when said middle portion is received in the opposed apertures, and including a second end portion outside of said container, proximate said second aperture, when said middle portion is received in the opposed apertures, said second portion having a hole therethrough for receiving a padlock, said opposed apertures being sized to receive said middle portion of said lock bar but not to pass said first end portion so the lock bar can be received in said apertures with the second end portion outside the wall of the container to accept a padlock through said hole, said lock bar and said inner surface of said container defining a space sufficiently large for the cord to pass through but not sufficiently large for the plug to pass through so as to retain the plug in said container;

whereby the plug is selectively captured in said container by at least one of said cap and said capturing means.

2. A device for impeding an unauthorized individual from plugging an electric plug into an electric receptacle, the plug having a cord extending therefrom, said apparatus comprising:

container means having an open end, said container being capable of receiving said plug;

child proof cap means;

an open-ended slot in one of said means, said slot being sufficiently large to receive the cord for passage of the cord out of said container, and said slot being sufficiently small so as to prevent the plug from leaving said container through said slot;

means on said container, complementary to the child proof cap, for engaging the child proof cap for selective attachment and removal of the child proof cap to and from the container, said open end of said container being closed by said cap when said means on said container engages said cap; and second capturing means, operable independently of said child proof cap, for selectively preventing removal of the plug from said container, said second capturing means being engageable by a padlock to secure said second capturing means to said container, said second capturing means comprising a generally planar lock bar including a middle portion having a first width and a first end portion having a width wider than the width of said middle portion and including a second end portion having a hole therethrough for receiving a padlock, wherein said container has a generally cylindrical wall, opposed apertures in said wall having a width adequate to receive said middle portion of said lock bar but not to pass said first end portion so the lock bar can be mounted in said apertures with the second end portion outside the wall of the container to accept a padlock through said hole, said second capturing means further comprising a space defined by said lock bar and said container between said lock bar and the wall of said container having a maximum width which allows the cord to pass through the space but which does not allow the plug to pass so as to retain the plug in said container.

3. A device in accordance with claim 2 wherein said child proof cap is of a push and turn type.

4. A device in accordance with claim 2 wherein said lock bar consists essentially of metal.

5. A device in accordance with claim 2 wherein said container consists essentially of plastic.

6. A device in accordance with claim 2 wherein said container comprises translucent plastic.

7. A device for impeding an unauthorized individual from plugging an electric plug into an electric receptacle, the plug having a cord extending therefrom, said apparatus comprising:

a container having an open end, said container being capable of receiving the plug;

a child proof cap;

an open-ended slot in one of said cap and said container, said slot being sufficiently large to receive the cord for passage of the cord out of said container, and said slot being sufficiently small so as to prevent the plug from leaving said container through said slot;

means on said container, complementary to the child proof cap, for engaging the child proof cap for selective attachment and removal of the child proof cap to and from said container, said open end of said container being closed by said cap when said means on said container engages said cap;

a generally planar lock bar including a middle portion having a first width and a first end portion having a width wider than the width of said middle portion and including a second end portion having a hole therethrough for receiving a padlock, wherein said container has a wall, opposed apertures in said wall having a width adequate to receive said middle portion of said lock bar but not to pass said first end portion so the lock bar can be mounted in said apertures with the second end portion outside the wall of the container to accept a padlock through said hole, said lock bar and said container defining a space between said lock bar and the wall of said container having a maximum width which allows the cord to pass through the space but which does not allow the plug to pass so as to retain the plug in said container.

8. A device in accordance with claim 7 wherein the container is in the general shape of a cylinder.

9. A device in accordance with claim 8 wherein said child proof cap is of a push and turn type.

10. A device in accordance with claim 9 wherein said lock bar consists essentially of metal.

11. A device in accordance with claim 10 wherein said container consists essentially of plastic.

12. A device in accordance with claim 11 wherein said container comprises translucent plastic.

* * * * *